United States Patent [19]

Nelson

[11] Patent Number: 5,031,430

[45] Date of Patent: Jul. 16, 1991

[54] KEY RING

[76] Inventor: Linden D. Nelson, c/o Cadillac Creative Advertising, 31535 Southfield Rd., Birmingham, Mich. 48009

[21] Appl. No.: 470,765

[22] Filed: Jan. 26, 1990

[51] Int. Cl.[5] ..... A47G 29/10

[52] U.S. Cl. ..... 70/456 R; 70/459

[58] Field of Search ..... 70/456 R, 459, 456 B; 24/3 R, 371, 234, 239; D3/61, 62; 206/37.1, 37.3

[56] References Cited

U.S. PATENT DOCUMENTS

| | | | |
|---|---|---|---|
| 271,443 | 11/1883 | MacDonald . | |
| 285,987 | 10/1886 | MacDonald . | |
| 306,799 | 3/1890 | Colan . | |
| 2,451,093 | 10/1947 | Kaminer . | |
| 2,527,491 | 11/1948 | Ballou . | |
| 2,916,907 | 12/1959 | Bridwell | 70/459 |
| 3,126,603 | 3/1964 | Cedarstaff . | |
| 3,597,951 | 8/1971 | Nadel | 70/459 |
| 4,129,021 | 12/1978 | Brentini . | |
| 4,164,132 | 8/1979 | Loman . | |
| 4,317,638 | 3/1982 | Klaber . | |
| 4,429,557 | 2/1984 | Morrone, III . | |
| 4,821,543 | 4/1989 | Scungio | 70/456 R |

FOREIGN PATENT DOCUMENTS

| | | |
|---|---|---|
| 1397455 | 3/1964 | France . |

*Primary Examiner*—Robert L. Wolfe
*Attorney, Agent, or Firm*—Spencer & Frank

[57] ABSTRACT

A double ended key ring includes a first body portion, a second body portion, and joining and biasing mechanisms for releasably engaging the first and second body portions together to form a key ring having openings on opposite ends. The first body portion is configured to form one of the openings and has a gap which is hidden when the first and second body portions are biased together in an engaged position. The first and second body portions can be moved axially and then rotated into an open position to expose the gap. In an alternate embodiment, the joining mechanism may be pushed from the second body portion toward the first body portion thereby disengaging the body portions from the engaged position.

14 Claims, 3 Drawing Sheets

KEY RING

FIELD OF THE INVENTION

The present invention relates to an improved key ring for retaining one or more keys on each of one or two key holders. More specifically, this invention relates to a double ended key ring having improved means for detachably removing at least one of the key holders.

BACKGROUND OF THE INVENTION

Conventional double ended key rings typically employ a pair of key holders that are located at opposite ends of a central housing. With such a key ring, keys desired to be retained on a single device may be segregated and placed on one of the key holders, which is removably secured to the key ring, thereby enabling the user of the keys to carry many keys while reducing the amount of fumbling and frustration when trying to locate the desired key or when trying to remove selected keys from the key ring. For example, automobile keys may be placed on one end of the key ring and house keys may be placed on the other end of the key ring to keep those keys separate and easily accessible. Examples of conventional double ended key rings are illustrated in MacDonald U.S. Pat. Nos. Des. 271,443 of Nov. 22, 1983, and Des. 285,987, of Oct. 7, 1986.

Bridwell U.S. Pat. No. 2,916,907 discloses a typical prior art double ended key ring which employs a pair of gapped, looped-like members to hold keys. The looped-like members are located at opposite ends of a tube or central housing, and are connected to one another by a biasing spring located within the tube. This biasing spring connection inexpensively allows removal of the keys from the looped-like members; however, a constant force is necessary to overcome the force of the biasing spring. Further, keys can only be individually removed through the gap of each looped-like members and thus, those keys can be easily lost once they are removed.

Another problem with the type of key ring disclosed by Bridwell is that the biasing spring can extend from the interior of the housing and thus is visible. A key ring which overcomes this aesthetically undesirable visibility utilizes a hook-like element having an external gapped, ring portion and an internal elongated shank portion that projects into an opening within a housing. A coiled spring is positioned about the shank with the coils located entirely within the housing. The housing has an inverted, saddle-like seat at one end thereof and the spring biases the external ring portion so that the ring portion is retracted into the inverted, saddle-like seat. The saddlelike seat has a pair of side walls which enclose the gap that is defined in the ring portion to prevent keys from being removed through the gap when the ring portion is retracted within the seat. This key ring is described in Nadel U.S. Pat. No. 3,597,951. While the key ring described by Nadel conceals the biasing mechanism, a constant force is still required to expose the gap of a ring portion and to remove the desired key.

Scungio U.S. Pat. No. 4,821,543 is directed to a double ended key ring having a pair of opposed, spaced key holders that are movably connected to a central housing having a pair of seats for the key holders located at opposite ends of the housing. Similar to the key holder arrangement of the Nadel patent, the key holders disclosed in the Scungio patent are biased to retract into one of the respective seats to prevent removal of the keys from the key holders. In order to remove a key retained on such key holders, the key holder is pulled away from the housing to expose the gap.

The majority of the above described double ended key rings are structured to hold keys individually and thus, keys can only be removed one at a time from the gapped ring portions. Thus there is a need for a key ring having a fast, reliable releasing mechanism which is also stylish and inexpensive. Furthermore, there is a need for a key ring having means for exposing a gap so that keys can be removed from the key ring without interfering with an operating key, such as an ignition key in a vehicle or the operation of the vehicle.

SUMMARY OF THE INVENTION

An object of this invention is to provide a key ring having at least one key holder, and preferably two key holders, one at each end of the key ring, where at least one of the key holders can be separated from the key ring. More particularly, this invention provides a key ring made of upper and lower body portions, each of which may have a key holder associated therewith, where at least one of the key holders can be detachably removed without interfering with the other key holder. Thus, for example, if a house key and an automobile ignition key are placed on separate key holders, with the key holders on opposite ends of the key ring, the ignition key may be easily removed from the key ring to remain with the automobile (such as when the automobile is given to a parking attendant) while the house key can be retained rather than being left with the automobile.

A further object of the invention is to provide a key ring having opposed key holders where one of the key holders is retained in an opening formed by upper and lower body portions in a biased, engaged position, with the key ring including a mechanism to overcome the bias force, which is activated by either pushing against one end of the key ring or axially pulling the other key ring end away from the key ring body portions. Once the bias force is overcome, the upper key ring body portion can be easily twisted into an open position for removal of the key holder.

Another object of this invention is to provide joining and biasing mechanisms which permit the key ring upper and lower body portions to move, relative to each other, both axially and rotatably between engaged and open positions. Further features of the invention permit one key ring body portion to remain in the open position, after rotation from an engaged position, to enable facile mounting or removal of a key holder from the key ring.

According to one embodiment of the present invention, a double ended key ring is provided comprising an upper or first body portion having an axis, an elongated opening for receiving a key holder and a bottom surface including a through hole along the axis; a lower or second body portion having an axis, a central bore along the axis and an upper surface; means for joining the first and second body portions with their axes aligned, the joined body portions being movable between an engaged position and an open position; and means for biasing the first and second body portions into the engaged position where the upper surface of the second body portion mates with the lower surface of the first body portion. When an axial force is applied opposite in direction to the biasing means, and of sufficient magnitude to overcome the biasing means, the first and second body portions are movable relative to each other from the engaged position into the open position which exposes the elongated opening and permits the removal of keys or mounting of keys onto the key holder.

A further object of this invention is to provide means for retaining a second key holder on the key ring which can freely rotate or swivel about the axis. An additional object of the invention is to provide a key ring which is simple and inexpensive to manufacture.

DESCRIPTION OF THE DRAWINGS

The various objects of the present invention, together with other advantages and benefits which may be attained by its use, will become more apparent upon reading the following detailed description of the invention taken in conjunction with the drawings. In the drawings, wherein like reference numerals identify corresponding portions of the various embodiments of the invention.

DETAILED DESCRIPTION OF THE PREFERRED EMBODIMENT

Figure 1:
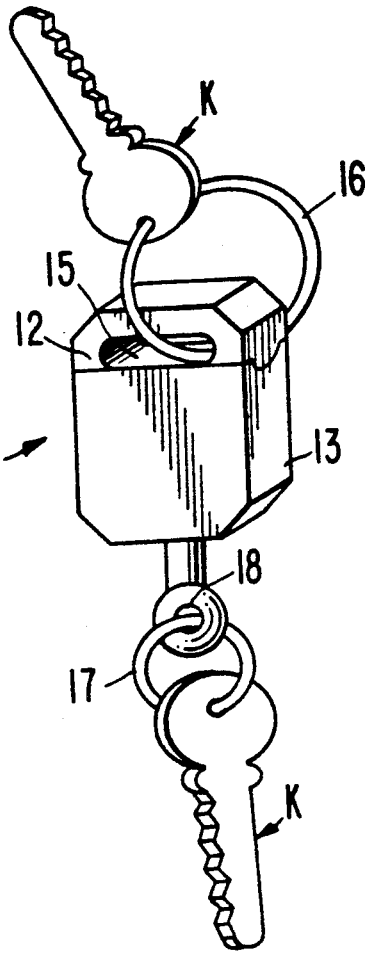
FIG. 1 is a front pictorial view of the key ring according to one embodiment of the present invention.

Referring first to FIG. 1 of the drawings, a double ended key ring 10 has openings at opposite ends thereof to receive one or more key holders each of which may contain one or more keys K. In the embodiment of FIGS. 1 through 5, the key ring 10 includes a first or upper body portion 12 having a slightly convex bottom surface 12' (see FIG. 5), a second or lower body portion 13 having a slightly concave upper surface 13', a joining mechanism 14 (shown in FIG. 4) and a biasing mechanism. The joining mechanism permits the body portions to move, relative to one another, between an open position for removing or receiving key holders and an engaged or closed position for retaining key holders.

Figure 2:
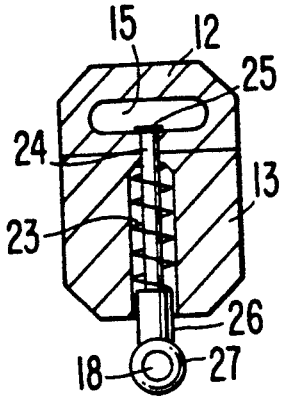
FIG. 2 is a front sectional view of the present invention showing the internal structure thereof.
Figure 3:
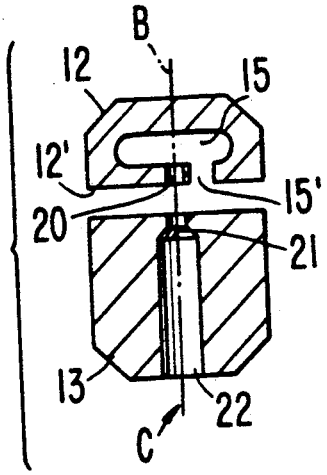
FIG. 3 is an exploded simplified front sectional view of the key ring shown in FIG. 1.
Figure 4:
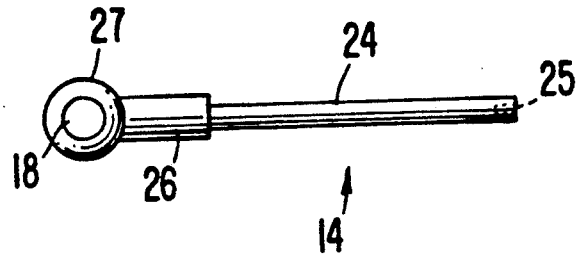
FIG. 4 is an enlarged view of the joining mechanism shown in the embodiment of FIGS. 1 through 3.
Figure 5:
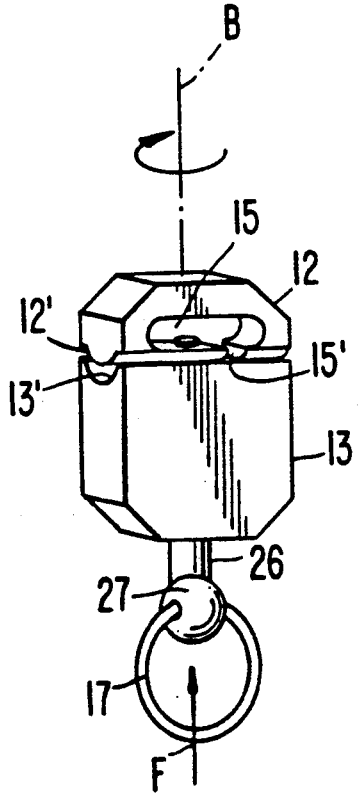
FIG. 5 illustrates diagrammatically the releasing mechanisms of the key ring according to the invention.

Referring in greater detail to FIGS. 1 through 3, the first or upper body portion 12 is configured generally as a thin rectangular plate having a hollow interior or opening 15, and with the slightly convex bottom surface 12' forming one side of the rectangle. A gap 15' is provided completely through the bottom surface 12' to permit access to the opening 15. When the key ring body portions are in the closed or engaged position, the gap 15' is concealed from view, as shown in FIGS. 1, 2 and 5. Thus, a first key holder 16 retaining a key K can be looped through opening 15 and is retained by key ring 10 when the body portions are in the engaged position.

A second key holder 17 can be looped through a second opening 18 attached to second body portion 13. Opening 18 preferably is provided on a portion of joining mechanism 14 which extends beyond second body 13 as will be further described.

Referring next to FIG. 3, the first body portion 12 has an axis B defined as a vertical axis relative to the orientation of the key ring in FIGS. 1 through 3. The bottom surface 12' of the first body portion has, in addition to gap 15', a small hole 20 therethrough which extends along the axis B of the first body portion. Gap 15' is laterally offset from the axis B.

The second body portion 13 is configured generally as a thin, square plate and includes an axis C which is defined as a vertical axis relative to the orientation of the key ring in FIGS. 1 through 3. A bore extends through the second body portion 13, from the top to the bottom as oriented in FIGS. 1 through 3, along the axis C. The bore includes an upper bore portion 21 of a smaller diameter, generally corresponding to the diameter of hole 20 and the bore includes a lower bore portion 22 of a larger diameter. The bore includes an internal step or shoulder between the two bore portions 21, 22.

As illustrated in FIGS. 1 and 5, the upper surface 13' of second body portion 13 is concave or recessed so that the protruding or convex lower surface 12' of first body portion 12 can be received therein in a mating configuration. A joining mechanism 14 extends through the bore along the axis C of second body portion 13 and through hole 20 into opening 15, as shown in FIG. 2. A biasing mechanism 23 which is illustrated in FIG. 2 as a spring, in connection with the joining mechanism 14 retains the two body portions together in the engaged position. When the body portions are in the engaged position not only is the gap 15' concealed but, in addition, inadvertent removal of a key holder 16 is prevented.

The joining mechanism 14 includes a pull-pin 24, configured as an elongated, circular cross-sectioned rod, having a first end which includes a hollow portion 25. The pull-pin 24 has an enlarged cylindrical portion or connection sleeve 26 at the opposite end. The biasing means cooperates with the joining mechanism for connecting and maintaining the body portions together. In the illustrated example, the pull-pin 24 is inserted through the spring 23, the pull-pin is thereafter inserted along the axis C through the larger diameter portion 22 of the bore, and then through the smaller diameter portion 21 of the bore, and then into the hole 20 of the upper body portion 12. The spring 23 is sufficiently large, in diameter, such that the spring preferably does not enter the bore 21 but rather is generally secured against axial movement (other than compression) between the sleeve 26 and the interior shoulder between the bore portions 21 and 22. The end 25 of the pull-pin 24 which extends through the hole 20 may be flared outwardly in the nature of a rivet to maintain the upper body portion 12 and the pull-pin 24 connected. The pull-pin 24, of course may be spot welded or otherwise secured to the upper body portion 12.

The diameter of sleeve 26 is such that it is rotatable in the lower bore 22. The joining and biasing means 14, 23 enable the lower surface 12' to be retained within upper surface 13' thus preventing a key holder looped through opening 15 from slipping through gap 15'.

In the embodiment of FIGS. 1 through 5, a solid sphere 27 is attached to the other end of connection sleeve 26 and a hole is drilled through the solid sphere to form opening 18. A second key holder 17 can be looped through this opening 18.

The operation of the key ring of the present invention will now be explained. The upper and lower body portions 12, 13 are pulled apart by a force exerted generally along the aligned axes B, C. The pulling force overcomes the biasing mechanism and causes spring 23 to be compressed slightly. Thereafter the upper and lower body portions 12, 13 are rotated or twisted relative to each other and relative to the aligned axes B, C. This twisting or rotational movement causes the bottom surface 12' of the upper body portion to be oriented transversely of the upper surface 13' of the lower body portion 13. In the rotated position, which may be considered the open position, gap 15' is exposed such that a key ring 16 may easily be inserted into or removed from the upper body portion. Thereafter, upon slight movement of the upper and lower body portions apart along the axes B, C, and by again rotating the upper and lower body portions relative to each other, the mating surfaces 12', 13' may again be aligned and the biasing mechanism will cause the body portions to return to the mating, engaged position preventing removal of a key ring 16. It should also be appreciated that in lieu of a key ring having keys thereon, an actual key may be engaged with the upper body portion.

Yet another aspect of the present invention will now be described. Referring again to FIG. 5, if a force F is applied along axis C in a direction from key holder 17 toward upper body 12, this force will cause movement of the joining mechanism along the axis C inwardly of the lower body portion 13 thus compressing spring 23. This movement of the joining mechanism will cause a corresponding movement of the upper body portion 12 relative to lower body portion 13. Thereafter, upper body portion 12 may be rotated relative to lower body portion 13 to expose gap 15' to enable keys or key holders to be engaged with or disengaged from the upper body portion 12 as heretofore described.

Thus there are two alternate techniques for separating the upper and lower body portion; one technique is by exerting opposed pulling forces on the two body portions and the second is by pushing upwardly on the joining mechanism to force the upper body portion away from the lower body portion.

The foregoing is a complete description of one embodiment of the present invention. Now with reference to FIGS. 6 and 7, the preferred form of the lower body portion and the preferred form of the joining means and biasing means will be explained.

Figure 6:
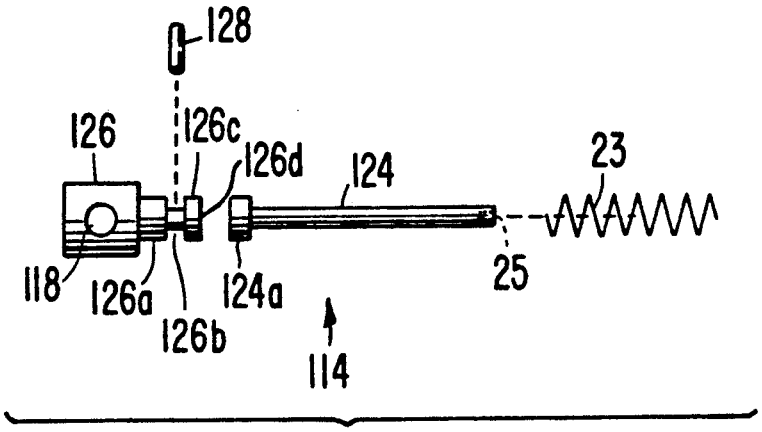
FIG. 6 is an enlarged, exploded view of the joining and biasing mechanisms of a second embodiment according to the invention.
Figure 7:
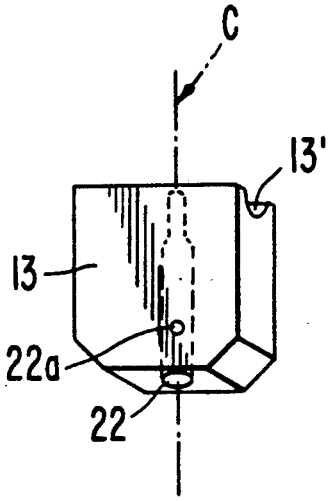
FIG. 7 is a partial rear pictorial view of the second body portion of the key ring, according to a second embodiment of the invention.

In the embodiment of FIGS. 6 and 7, the upper body portion 12 may, in all respects, be the upper body portion heretofore described. The lower body portion 13 will be the same as the lower body portion heretofore described with respect to FIGS. 1 through 5 except that the lower body portion includes aperture **22*a* extending through the face thereof in communication with the lower bore portion 22** adjacent the lower end of the bore.

Referring to FIG. 6, a joining mechanism 114 which operates in conjunction with a biasing mechanism 23 will now be explained. The joining mechanism includes a pull-pin 124 formed as an elongated rod of circular cross section, having an enlarged cylindrical head **124*a* at one end, and a short hollow opposite end 25. A swivel connection sleeve 126 includes a reduced diameter cylindrical portion 126*a* having an end 126*c*. A circumferential groove 126*b* is provided in the sleeve 126 just inwardly of end 126*c*. To assemble the joining and biasing mechanisms and the upper and lower body portions, the pull-pin 125 is inserted through the spring 23 and thereafter into the bore 22 from the bottom of the bore along the axis C. The enlarged cylindrical head 124*a* retains the spring 23 within the bore 22. The upper end 25 of the pull-pin is connected to the lower surface 12' of the upper body portion 12 by a conventional technique such as one of the techniques heretofore described in connection with FIGS. 1 through 5 with a flared rivet connection being preferred. Thereafter, the sleeve portion is attached, specifically the reduced diameter portion 126*a* of sleeve 126 is inserted into the bore 22 until the circumferential groove 126*b* is aligned with aperture 22*a* in the lower body portion 13. At that time, a pin or rod 28 having a suitable diameter is force fit through the aperture 22*a* and into the groove 126*b*. This connects the sleeve structure to the lower body portion and retains the pull-pin 124 in the lower body portion. The sleeve 126 includes a bore 118 therethrough to receive a second key holder 17**.

In the embodiment of FIGS. 6 and 7, the upper and lower body portions may be separated by external forces applied generally along axes B, C for the purpose of separating the body portions for adding or removing keys or key holders through the gap 15'.

In both embodiments the spring is preferably stainless steel and the other components are brass. After the key ring is assembled conventional metal finishing is employed such as sanding (tumbling) polishing and decorative plating. The key ring can also be made of other strong or rigid material, such as plastics, wood, etc. The first and second body portions may be formed through a casting, machining or molding operation. The second body may be embossed with a trademark or logo of an automobile manufacturer or other decorative designs. The joining mechanism of the aforementioned U.S. Pat. No. 4,821,543 may also be employed.

While specific embodiments of the invention have been shown and described, it should be understood that modifications may be made without deviating from the scope of the present invention.

What is claimed is:

1. A key ring comprising:

a first body portion having an axis;

a second body portion having an axis and having a central bore along said axis;

means for rotatably joining said first and second body portions with the axes aligned;

said first and second body portions having an engaged position and being movable relative to each other along said axes to an open position;

said first body portion having an opening therethrough for retaining keys such as by a key holder in said opening and an access to said opening;

said access being closed when said first and second body portions are in said engaged position to prevent removal of retaining keys, the movement of said first and second body portions into said open position for exposing said access to permit removal of keys;

means for biasing said first and second body portions into said engaged position, and means extending outwardly of said central bore and outwardly of said second body portion for receiving at least a second key holder.

2. The invention a defined in claim 1 wherein said joining means includes means for overcoming said biasing means for moving said first and second body portions from said engaged position to said open position.

3. The invention as defined in claim 1, wherein said first body portion has a generally rectangular bottom surface and said second body portion has a generally rectangular upper surface, said generally rectangular upper and bottom surfaces being configured complementary to each other to mate in the engaged position.

4. The invention as defined in claim 1, wherein the first and second body portions are movable about the aligned axes, relative to each other, both axially and rotatably.

5. The invention as defined in claim 4, wherein at least a part of the joining means is moved along said axes from said second body portion toward said first body portion by application of force external to said key ring for axially moving the first and second body portions relative to each other.

6. The invention as defined in claim 3, wherein the first body portion has a hole extending through the generally rectangular bottom surface into the opening along the axis and the central bore through the second body portion along the axis.

7. The invention as defined in claim 1 wherein the joining means includes a pin extending through the second body portion and into the first body portion along the aligned axes, and the biasing means is positioned about the pin.

8. The invention as defined in claim 7, wherein the means extending outwardly of the central bore for receiving at least a second key holder is part of said joining means and is rotatably relative to the axis of said second body.

9. The invention as defined in claim 7, wherein the access is a gap in the bottom surface of the first body portion, said gap being concealed when the key ring is in the engaged position.

10. The invention as defined in claim 9, wherein the first and second body portions are moved axially from the engaged position and then are rotated about the aligned axes into the open position thereby exposing the gap.

11. The invention as defined in claim 1, wherein the rotated body portions remain in the open position against the biasing means during removal and mounting of at least one key holder.

12. A key ring comprising:

a first body portion having an axis;

a second body portion having an axis and having a central bore along said axis;

means for rotatably joining said first and second body portions with the axes aligned;

said first and second body portions having an engaged position and being movable relative to each other along said axes to an open position;

said first body portion having an opening therethrough for retaining keys such as by a key holder in said opening and an access to said opening;

said access being closed when said first and second body portions are in said engaged position to prevent removal of retained keys, the movement of said first and second body portions into said open position for exposing said access to permit removal of keys;

means for biasing said first and second body portions into said engaged position, and means extending along the axis of said second body portion in a direction away from said first body portion for rotatably receiving at least a second key holder, said second key holder receiving means rotatably relative to said axis of said second body portion.

13. The invention as defined in claim 12 wherein said second key holder receiving means is discrete from said joining means.

14. The invention as defined in claim 12 wherein said joining means includes a pin extending through the second body portion and into the first body portion along the aligned axes, said biasing means being positioned about said pin, said second key holder receiving means being an aperture through said pin transversely of said aligned axes.

* * * * *